US006305513B1

(12) United States Patent
Lu

(10) Patent No.: US 6,305,513 B1
(45) Date of Patent: Oct. 23, 2001

(54) MECHANISM FOR SUPPORTING EXPANDABLE POUCH OF LUGGAGE

(75) Inventor: Lieh Ching Lu, Miaoli Hsien (TW)

(73) Assignee: Ting Cheng Co., Ltd., Miaoli Hsien (TW)

( * ) Notice: Subject to any disclaimer, the term of this patent is extended or adjusted under 35 U.S.C. 154(b) by 0 days.

(21) Appl. No.: 09/711,143

(22) Filed: Nov. 14, 2000

(51) Int. Cl.[7] ..... A45C 7/00
(52) U.S. Cl. ..... 190/103; 190/105
(58) Field of Search ..... 190/103, 105, 190/104, 107

(56) References Cited

U.S. PATENT DOCUMENTS 5,671,831 * 9/1997 Chiu ..... 190/103
5,749,446 * 5/1998 Hsieh ..... 190/103
6,021,874 * 2/2000 Nykoluk ..... 190/103
6,220,411 * 4/2001 Scicluna et al. ..... 190/103

* cited by examiner

*Primary Examiner*—Allan N. Shoap
*Assistant Examiner*—Tri M. Mai
(74) *Attorney, Agent, or Firm*—Rosenberg, Klein & Lee

(57) ABSTRACT

A mechanism is provided for supporting an expandable pouch of luggage coupled between a main body and a frame element. The support mechanism is provided at about the central portion on either side of luggage interconnected between the main frame and the frame element. Support mechanism comprises a sliding plate, an engagement plate including a horizontal ratchet member adjacent either top or bottom side, and a lock mechanism on the sliding plate being capable of engaging with the ratchet member of the engagement plate thus controlling the sliding and locking of the sliding plate with respect to the engagement plate. The support mechanisms are formed as two side supports of the expandable pouch for preventing the packed luggage from bulging at the bottom of expandable pouch.

1 Claim, 7 Drawing Sheets

MECHANISM FOR SUPPORTING EXPANDABLE POUCH OF LUGGAGE

FIELD OF THE INVENTION

The present invention relates to luggage and more particularly to an improved mechanism for supporting/locking expandable pouch of luggage.

BACKGROUND OF THE INVENTION

A conventional expandable luggage 10 is shown in FIGS. 1 and 2 comprising a main body 11 supported by a main frame 14, a frame element 15, an expandable pouch 13 coupled between main body 11 and frame element 15, and a door panel 12 coupled to frame element 15 by a zipper. A zipper 131 is provided on expandable pouch 13 wherein the expandable pouch 13 is expanded to its maximum when zipper 131 is open and the expandable pouch 13 is retracted to its minimum when zipper 131 is closed. However, the previous design suffered from several disadvantages. In detail, the expanded expandable pouch 13 is not supported by any mechanism. As such, the bottom 132 of expandable pouch 13 may be bulged downwardly due to the weight of items packed in the luggage 10 (FIG. 2). This may obstruct the smoothness when towing the luggage, or in an extreme case cause the damage of luggage 10. Further, luggage 10 tends to deform after a plurality of times of use due to the bulged bottom 132 of expandable pouch 13. Furthermore, luggage 10 may not stand upright easily due to the bulged bottom 132 of expandable pouch 13.

SUMMARY OF THE INVENTION

It is thus an object of the present invention to provide a mechanism for supporting an expandable pouch of luggage coupled between a main body and a frame element. The support mechanism is provided at about the central portion on either side of luggage interconnected between the main frame and the frame element. With the provision of support mechanisms formed as two side supports of the expandable pouch, it is possible to prevent the packed luggage from bulging at the bottom of expandable pouch.

The above and other objects, features and advantages of the present invention will become apparent from the following detailed description taken with the accompanying drawings.

DETAILED DESCRIPTION OF THE PREFERRED EMBODIMENTS

Figure 1:
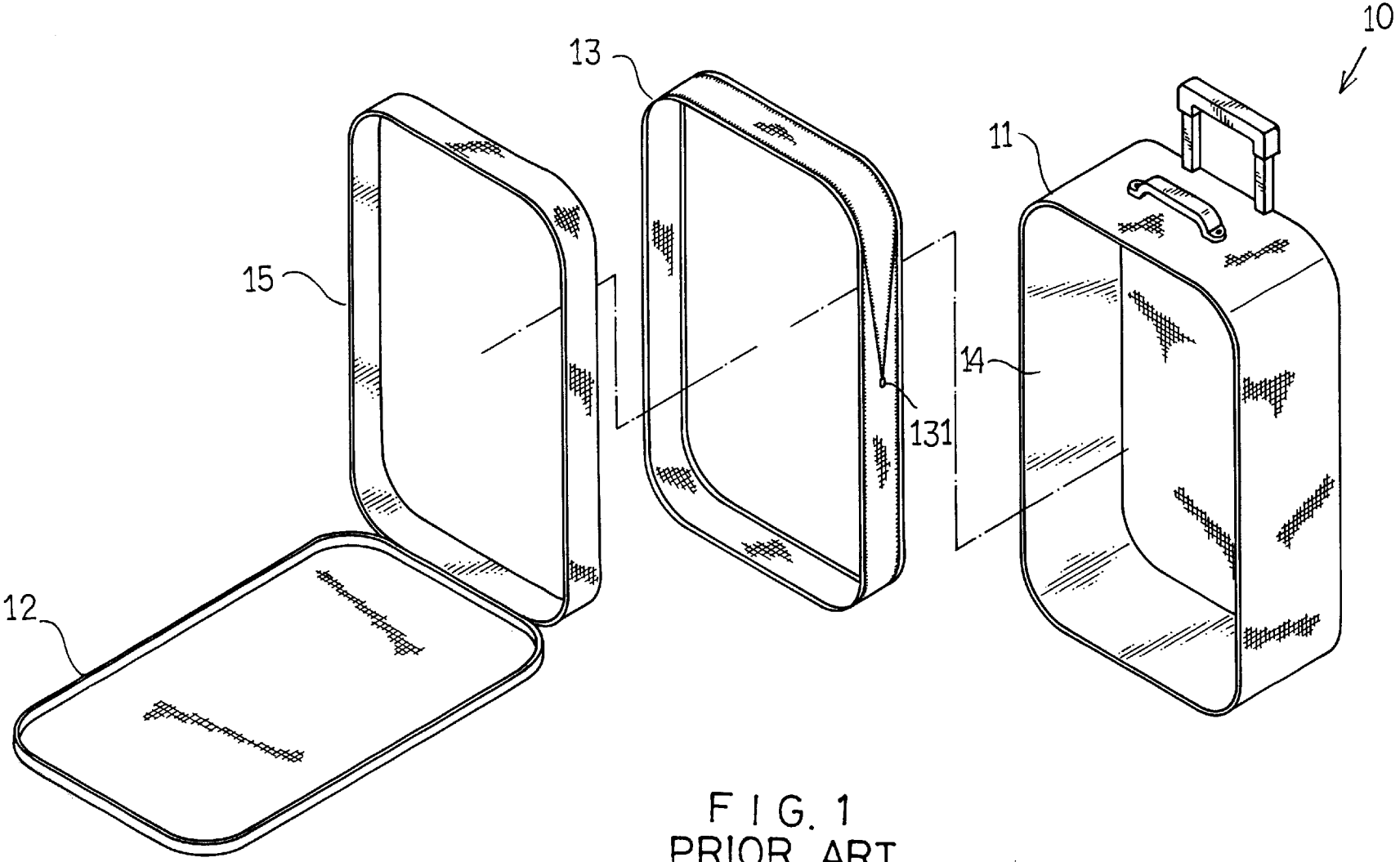
FIG. 1 PRIOR ART
FIG. 1 is an exploded view of a conventional expandable luggage.
Figure 2:
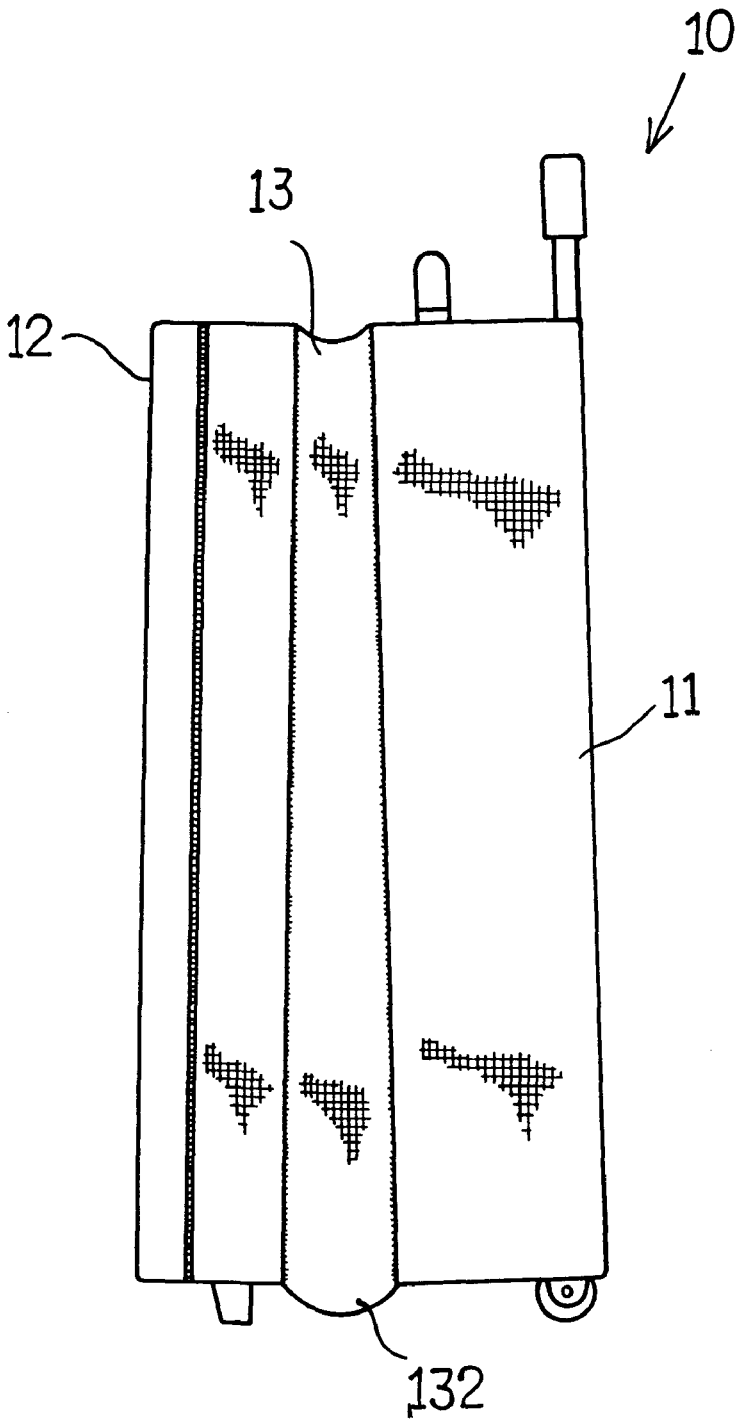
FIG. 2 PRIOR ART
FIG. 2 is side view showing the bulged bottom of the expandable pouch of luggage shown in FIG. 1.
Figure 3:
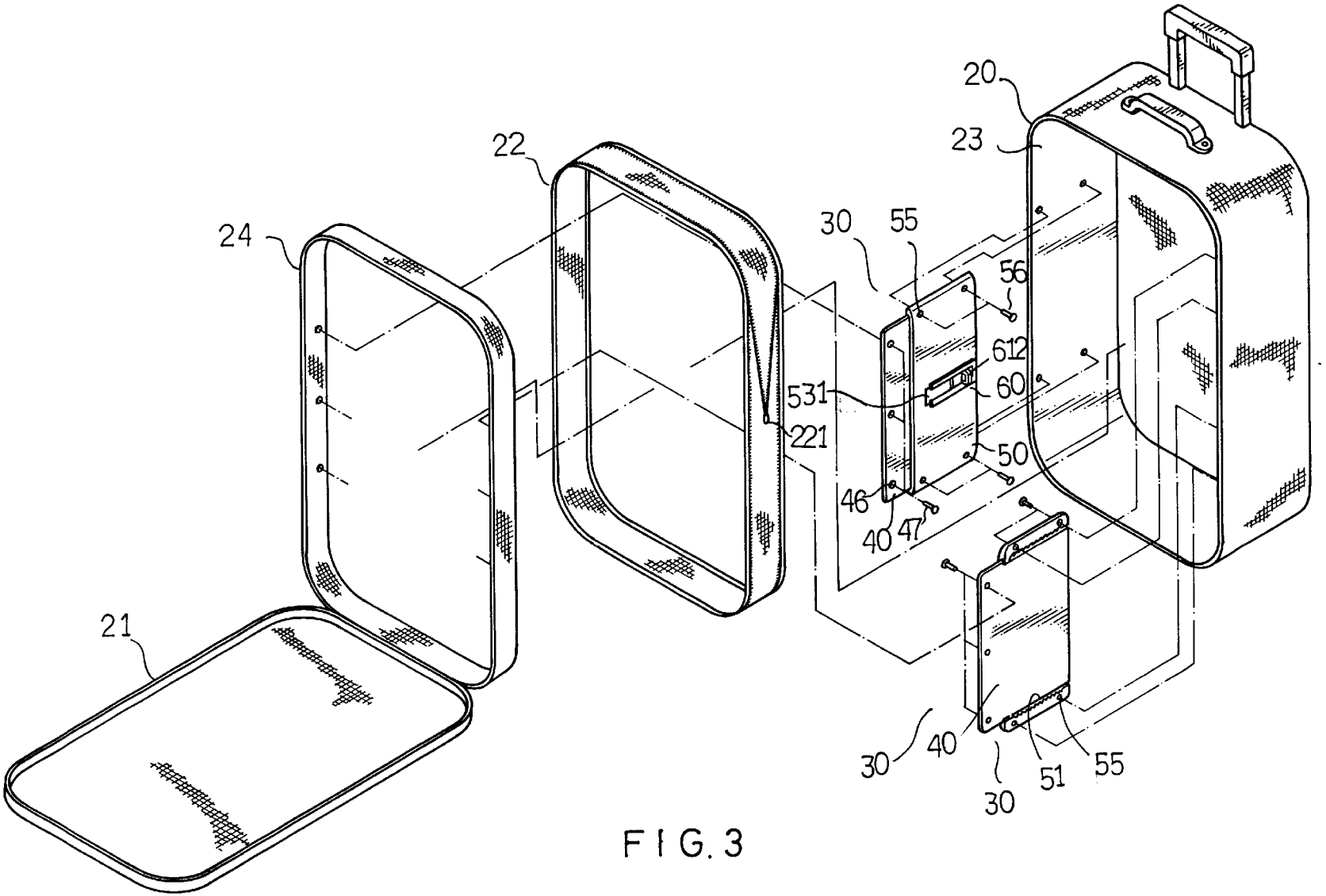
FIG. 3 is an exploded view of a luggage incorporating a support mechanism for supporting an expandable pouch according to the invention.
Figure 4:
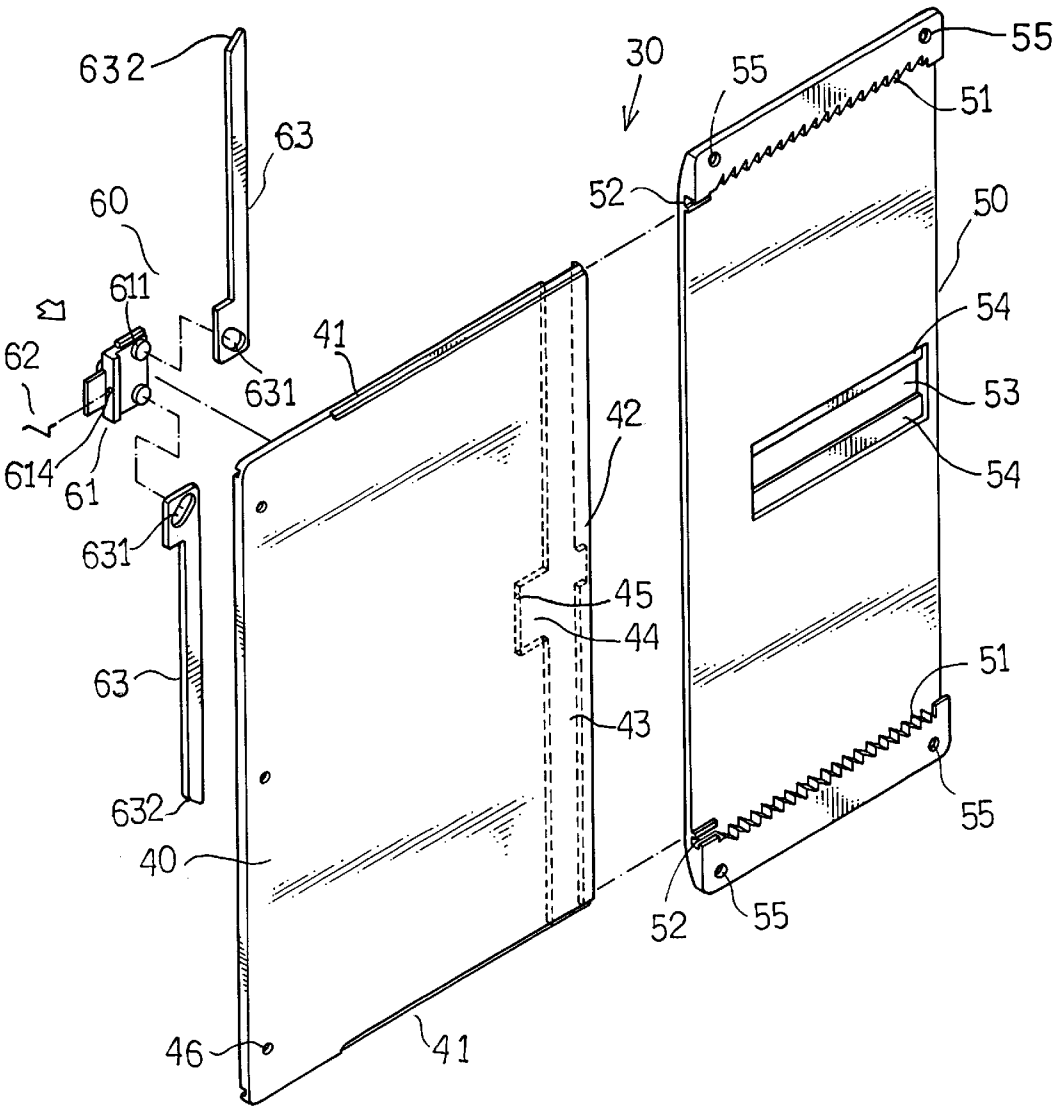
FIG. 4 is an exploded view of the FIG. 3 support mechanism.
Figure 4:
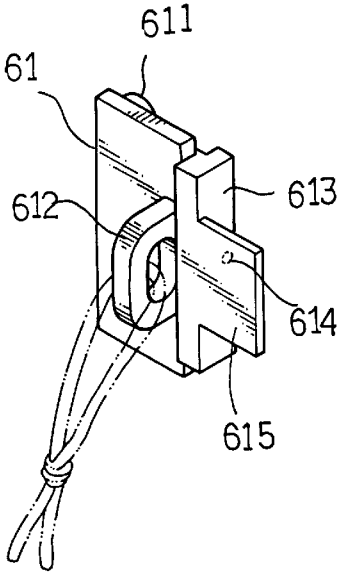
Figure 5:
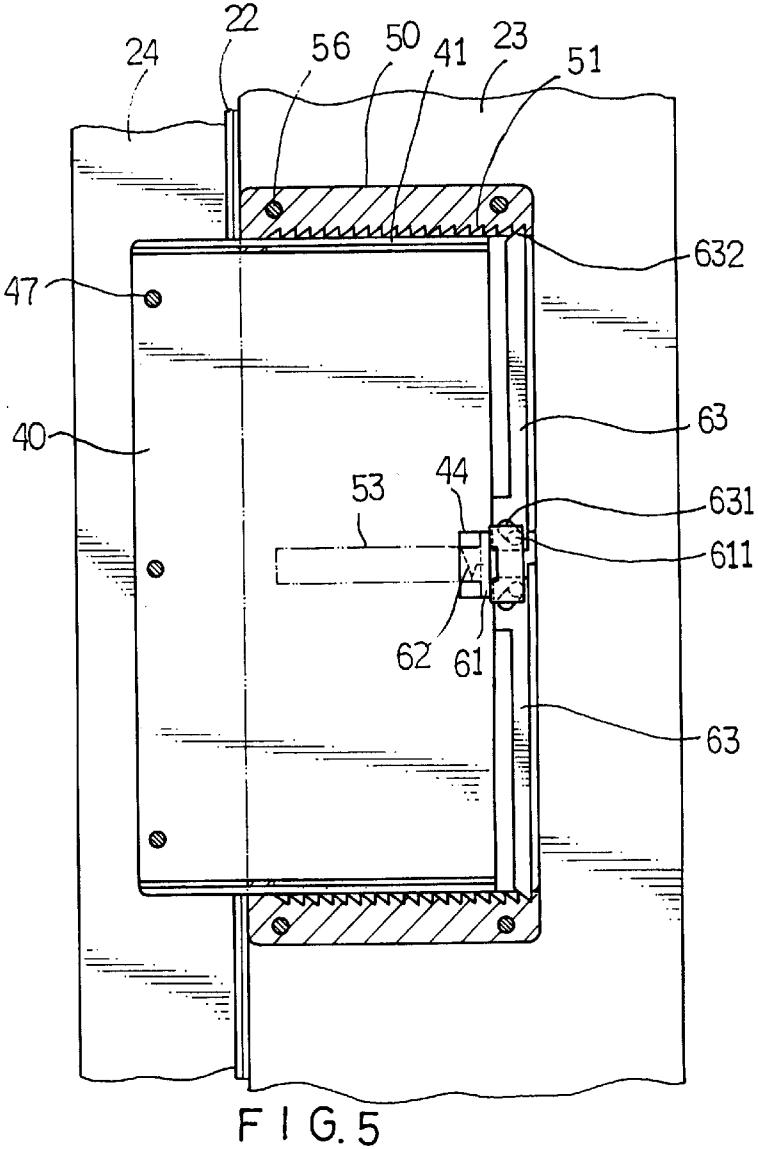
FIG. 5 is a side view of the assembled FIG. 4 support mechanism wherein expandable pouch is retracted.
Figure 6:
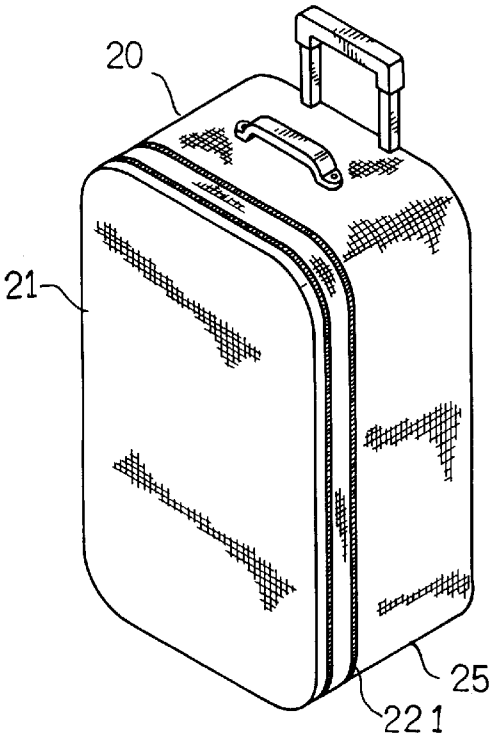
FIG. 6 is a perspective view of the FIG. 3 luggage wherein expandable pouch is retracted.

Referring to FIGS. 3 to 6, there is shown a luggage incorporating a mechanism for supporting the expandable pouch of luggage constructed in accordance with the invention comprising a main body 20 supported by a main frame 23, a frame element 24, an expandable pouch 22 coupled between main body 20 and frame element 24, and a door panel 21 coupled to frame element 24 by a zipper. A zipper 221 is provided on expandable pouch 22 wherein the expandable pouch 22 is expanded to its maximum when zipper 221 is open and the expandable pouch 22 is retracted to its minimum when zipper 221 is closed. The characteristics of the invention is that a support mechanism 30 is provided at about the central portion on either side of luggage interconnected between main frame 23 and frame element 24. Support mechanism 30 comprises a substantially rectangular sliding plate 40, a substantially rectangular engagement plate 50, and a lock mechanism 60.

Sliding plate 40 comprises a guide rail 41 on either top or bottom side, an open-ended vertical groove 43 along one side interconnected between guide rails 41, a horizontal slot 44 on the central part of vertical groove 43, a receiving space 42 formed by vertical groove 43 and horizontal slot 44 for receiving lock mechanism 60, a hole 45 in the horizontal slot 44, and a plurality of (three are shown) threaded holes 46 spaced along the other side for permitting fasteners (e.g., bolts) 47 to drive through to secure sliding plate 40 to frame element 24. Engagement plate 50 comprises a horizontal ratchet member 51 adjacent either top or bottom side, a guide recess 52 on one end of ratchet member 51 for guiding guide rail 41 into engagement with ratchet member 51, a horizontal groove 53 in the central part disposed corresponding to horizontal slot 44, the horizontal groove 53 having a front open end 531, a horizontal elongated riser 54 on either top or bottom side of horizontal groove 53, and a plurality of (two are shown) threaded holes 55 between top side and upper ratchet member 51 or between bottom side and lower ratchet member 51 for permitting fasteners (e.g., bolts) 56 to drive through to secure engagement plate 50 to main frame 23. Lock mechanism 60 comprises a lock body 61 received in horizontal slot 44 being slidingly secured between sliding plate 40 and horizontal groove 53, lock body 61 including a pair of rounded projections 611 on the rear surface, a hollow ear 612 projected on the outer surface with a rope looped around the hole thereof, a vertical member 613 on the side, a hole 614 on the vertical member 613, and a stop plate 615 extended laterally from the vertical member 613; a substantially N-shaped spring 62 having one end received in hole 45 and the other end received in hole 614; and a pair of positioning members 63 received in vertical groove 43, each positioning member 63 including a slanted oval aperture 631 at one end put on rounded projection 611 and a slanted surface 632 at the other end capable of engaging with ratchet member 51.

Figure 7:
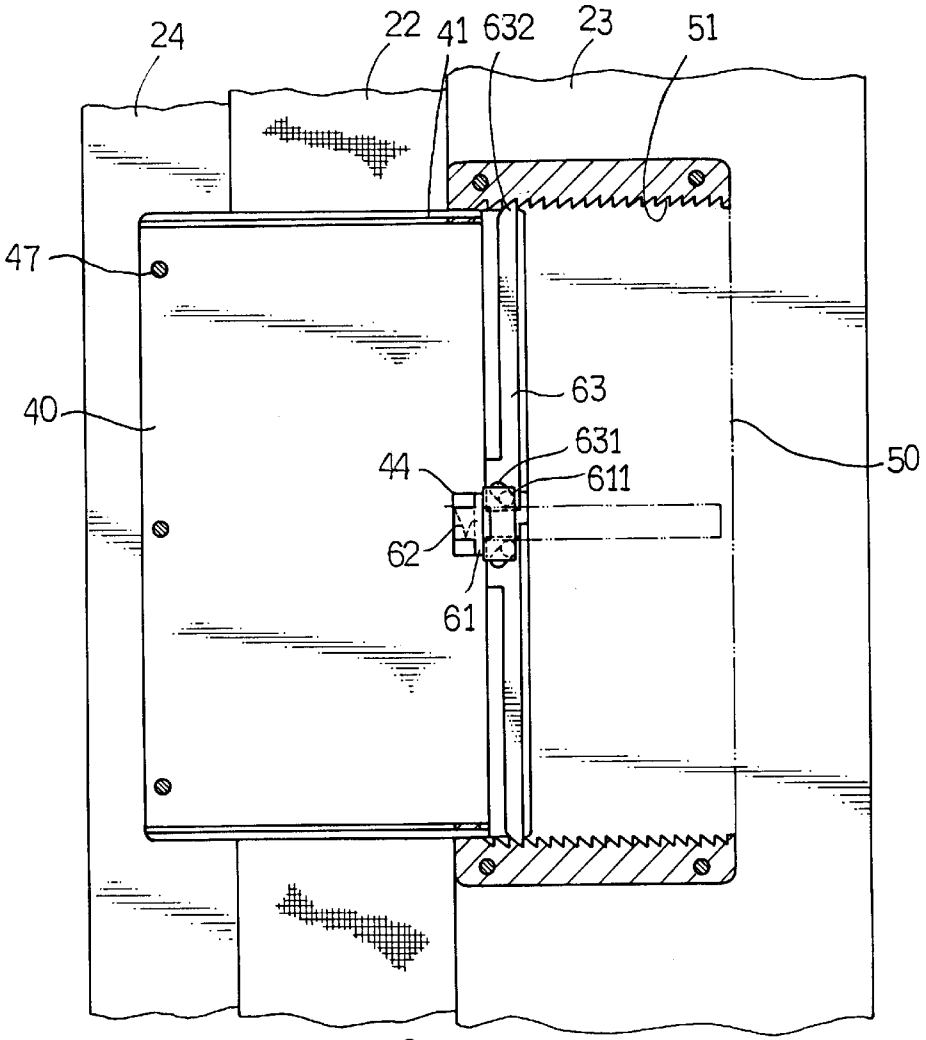
FIG. 7 is a side view of the assembled FIG. 4 support mechanism wherein expandable pouch is expanded.
Figure 8:
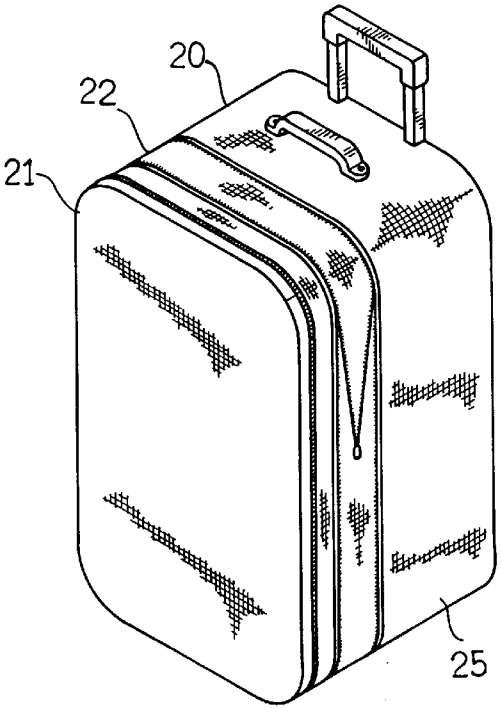
FIG. 8 is a perspective view of the FIG. 3 luggage wherein expandable pouch is expanded.
Figure 9:
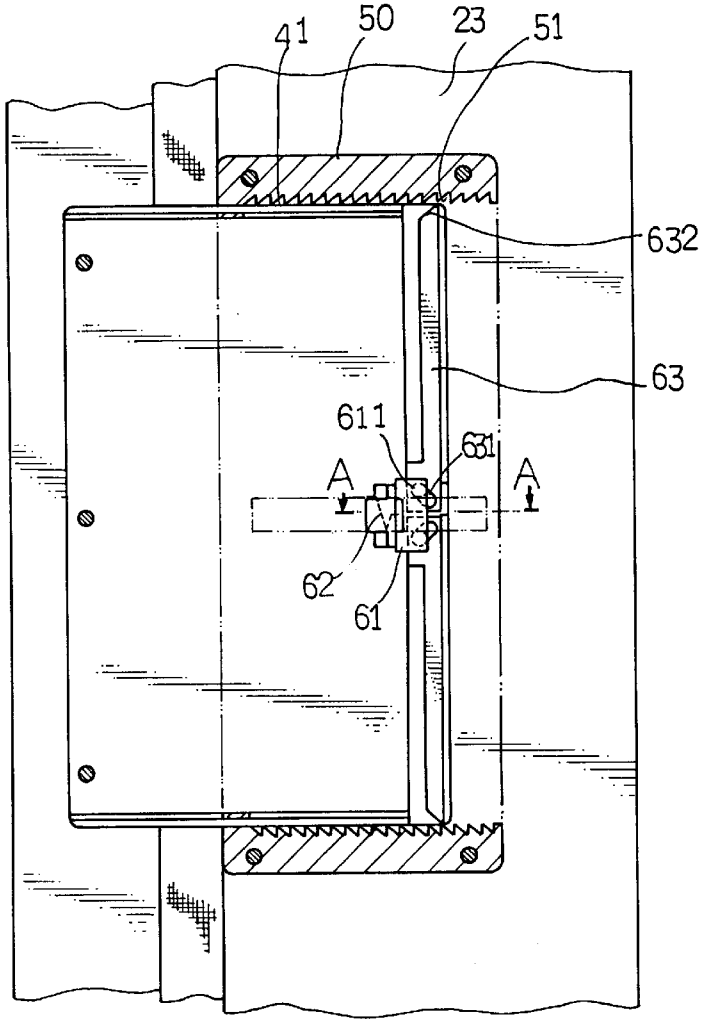
FIG. 9 is a side view showing the retracting FIG. 4 support mechanism.
Figure 10:
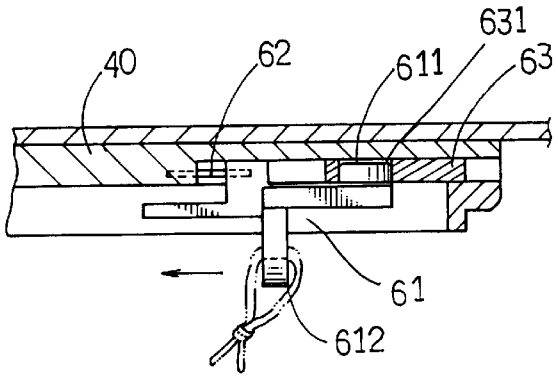
FIG. 10 is a cross-sectional view taken along line A—A of FIG. 9.

Referring to FIGS. 7 to 10, the operation of the invention will now be described. When a user wants to increase the packing space of luggage, the user may first open zipper 221 to reveal expandable pouch 22. Then expand the expandable pouch 22. At the same time, sliding plate 40 is slid laterally from engagement plate 50 because the slanted surfaces 632 are allowed to move in the forward direction only (i.e., not locked by ratchet members 51). Also, lock body 61 is slid along horizontal groove 53 until stop plate 615 is stopped by the open end 531 of horizontal groove 53, i.e., sliding plate 40 is stopped when expandable pouch 22 is expanded to its maximum and the slanted surfaces 632 are locked by ratchet members 51 again. These support mechanisms 30 form two side supports of expandable pouch 2 thus preventing the packed luggage from bulging at the bottom of expandable pouch 22 (see FIGS. 7 and 8). To the contrary when user wants to decrease the packing space of luggage, simply pull ear 612 forward (FIG. 10) to compress spring 62 to cause positioning members 63 to move vertically toward each other. That is, rounded projections 611 move from the lowest first positions in the slanted oval aperture 631 (in the locked supported state of expandable pouch 22) to the highest second positions thereof. At this position, the slanted surfaces 632 are not locked by ratchet members 51. Thus, it is possible to slide sliding plate 40 rearward to retract into the position between ratchet members 51 until being stopped (see FIG. 9). At this time, release ear 612 to cause the compressed spring 62 to expand to move lock body 61 rearward slightly. As such, lock body 61 is positioned at the position as shown in FIG. 5 again wherein positioning members 63 are moved vertically away from each other. That is, rounded projections 611 move from the highest second positions in the slanted oval aperture 631 (in the unlocked state of expandable pouch 22) to the lowest first positions thereof. At this position, the slanted surfaces 632 are locked by ratchet members 51 again.

While the invention has been described by means of specific embodiments, numerous modifications and variations could be made thereto by those skilled in the art without departing from the scope and spirit of the invention set forth in the claims.

What is claimed is:

1. A luggage comprising:

a main body having a main frame a frame element, an expandable pouch coupled between the main body and the frame element, the expandable pouch having a zipper for controlling the retraction thereof, and a front door panel hinged to the frame element; and a support mechanism on either side of the main body interconnected between the main frame and the frame element, the support mechanism having a substantially rectangular sliding plate releasably secured to the frame element, the sliding plate including a guide rail on either top or bottom side, an open-ended vertical groove along one side interconnected between the guide rails, a horizontal slot on the central part of the vertical groove, a receiving space formed by the vertical groove and the horizontal slot, and a first hole in the horizontal slot; a substantially rectangular engagement plate releasably secured to the main frame, the engagement plate including a horizontal ratchet member adjacent either top or bottom side, a guide recess on one end of the ratchet member for guiding the guide rail into engagement with the ratchet member, a horizontal groove in the central part disposed corresponding to the horizontal slot, the horizontal groove having a front open end, and a horizontal elongated riser on either top or bottom side of the horizontal groove; and a lock mechanism including a lock body received in the horizontal slot being slidingly secured between the sliding plate and the horizontal groove, the lock body including a pair of rounded projections on the rear surface, an ear projected on the outer surface, a vertical member on the side, a second hole on the vertical member, and a stop plate extended laterally from the vertical member, a spring having one end received in the first hole and the other end received in the second hole, and a pair of positioning members received in the vertical groove, each positioning member including a slanted oval aperture at one end put on the rounded projection and a slanted surface at the other end capable of engaging with the ratchet member, wherein in a first operation, open the zipper to expand the expandable pouch the sliding plate is operable to slide forwardly from the engagement plate, the lock body is slid along the horizontal groove until the stop plate is stopped by the open end of the horizontal groove, and the slanted surfaces are engaged with the ratchet members; and in a second operation, pull the ear forward to compress the spring to cause the positioning members to move vertically toward each other to cause the rounded projections to move from lowest first positions in the slanted oval aperture to highest second positions thereof, thus unlocking the slanted surfaces for sliding the sliding plate rearward until being stopped, and release the ear to cause the compressed spring to expand to move the lock body rearward for moving the positioning members away from each other to cause the rounded projections to move from the highest second positions in the slanted oval aperture to the lowest first positions thereof, thereby enabling the ratchet members to lock the slanted surfaces.

* * * * *